United States Patent [19]

Gregorich et al.

[11] Patent Number: 4,690,245

[45] Date of Patent: Sep. 1, 1987

[54] FLATTENED VENTURI, METHOD AND APPARATUS FOR MAKING

[75] Inventors: Edward E. Gregorich; Timothy R. Maher, both of Longview, Tex.

[73] Assignee: Stemco, Inc., Longview, Tex.

[21] Appl. No.: 931,903

[22] Filed: Nov. 14, 1986

Related U.S. Application Data

[63] Continuation of Ser. No. 476,280, Mar. 17, 1983, abandoned, which is a continuation-in-part of Ser. No. 366,967, Apr. 9, 1982, abandoned.

[51] Int. Cl.[4] ..... F01N 1/08

[52] U.S. Cl. ..... 181/272; 181/249; 181/265; 138/40

[58] Field of Search ..... 181/231, 248, 249, 255, 181/262, 272, 269, 264, 227; 138/39–41, 44

[56] References Cited

U.S. PATENT DOCUMENTS

| | | | |
|---|---|---|---|
| 956,785 | 5/1910 | Thomas | 181/227 |
| 1,611,475 | 12/1926 | Maxim | 181/249 |
| 2,892,253 | 6/1959 | Hutchins et al. | 29/421 |
| 2,926,743 | 3/1960 | Melchior | 181/251 |
| 3,120,206 | 2/1964 | Sporck | 113/52 |
| 3,672,464 | 6/1972 | Rowley et al. | 181/255 |
| 3,857,458 | 12/1974 | Ohtani et al. | 181/262 |
| 4,150,558 | 4/1979 | Pohl | 138/40 |
| 4,267,899 | 5/1981 | Wagner et al. | 181/272 |
| 4,361,206 | 11/1982 | Tsai | 181/255 |
| 4,424,882 | 1/1984 | Moller | 181/231 |

*Primary Examiner*—Benjamin R. Fuller

*Attorney, Agent, or Firm*—Woodcock Washburn Kurtz Mackiewicz & Norris

[57] ABSTRACT

The invention is a venturi of unusual configuration and a method and apparatus for forming such a venturi in a single operation from a rounded, deformable tube. According to the invention, diametrically opposing sides of the tube are inwardly deflected in increasing amounts from opposing ends of the tube so as to form along the length of the tube from either end a first chamber of increasingly flattened and reduced cross-section followed by a second chamber of decreasingly flattened and reduced cross-section. An elongated throat section of maximally flattened and reduced cross-section may be provided between the first and second chambers, particularly for engine muffler venturis. The tube is conveniently deformed by applying pressure to a pair of its opposing sides along at least a portion of its length, preferably by pairs of opposing dies or eccentric rollers. Venturis for engine mufflers are conveniently fabricated from thin walled steel tubes by cold forming the tubes in the manner described. In cold forming, sidewalls between the flattened walls are typically outwardly bulged as well. The outward bulging may be constrained such that the central throat section has a substantially rectangular cross-sectional shape.

16 Claims, 25 Drawing Figures

FIG. Ia

FIG. 13
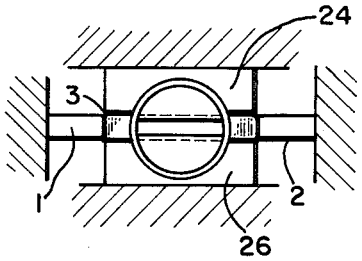
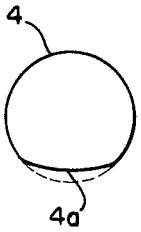
FIG. 14a
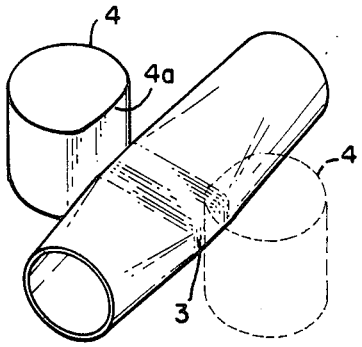
FIG. 14
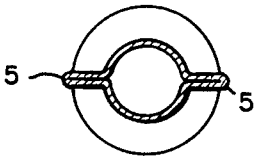
FIG. 16
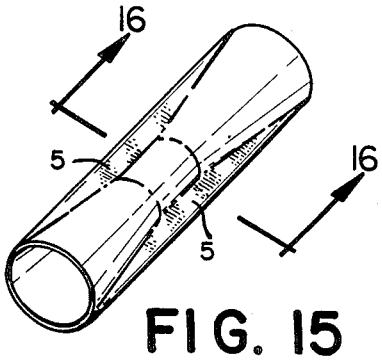
FIG. 15

FLATTENED VENTURI, METHOD AND APPARATUS FOR MAKING

This application is a continuation of Ser. No. 476,280 filed Mar. 17, 1983 now abandoned which is a continuation in part of Ser. No. 366,967 filed Apr. 9, 1982 now abandoned.

BACKGROUND OF THE INVENTION

This invention relates to venturis, i.e. tubes through which a fluid is passed having flaring ends connected by a constricted middle and in particular to an easily manufactured venturi of unusual geometry and methods and apparatus for forming the venturi.

Venturis can be beneficially employed in mufflers to attenuate engine exhaust noise. See, for example, U.S. Pat. Nos. 4,267,899 to Wagner et al, 3,672,464 to Rowley et al and commonly assigned 4,361,206 to Tsai. A significant characteristic militating against the widespread use of venturis in mufflers is the cost associated with their manufacture. As can be seen from the aforesaid patents, the venturis heretofore employed in muffler construction have been concentrically symmetric having substantially circular transverse cross-sectional areas along their entire area. Formation of such conical sections is a complex manufacturing problem. For example, the metal venturis used in mufflers are typically fabricated from flat sheet metal stock. One approach used to form venturis from such sheet metal stock has been to fabricate cylindrical, frustro-conical and/or frustro-conically top cylindrical sections from flat sheet stock by cutting, bending and joining sides of the cut stock, typically by welding or brazing, and then joining two or more of the sections, again typically by welding or brazing, to form the venturi. The number of separate cutting, bending and joining steps required adds greatly to the cost of this method of manufacture. Alternatively, such venturi shapes have been formed from cylindrical tubes of substantially constant cross-sectional diameter by flaring the ends or inwardly spinning the center of the tube or both as is described, for example, in U.S. Pat. Nos. 3,120,206 and 2,892,253. The former operation can easily result in splitting of the tube if not properly performed. The latter operation can result in crimping of the sidewall. Both processes become more difficult to perform where the side wall of the tube is seamed. Moreover, several successive flaring or spinning operations or both may be necessary to form an abrupt constriction in the tube without damage.

OBJECTS OF THE INVENTION

It is an object of the invention to provide improved methods and apparatus for fabricating venturis, particularly from deformable thin walled tubes.

It is yet another object of the invention to form venturis from such tubes in a single deforming step.

It is yet another object of the invention to provide methods for inexpensively forming venturis suitable for use in engine muffler and other applications.

It is yet another object of the invention to provide less expensive apparatus for use in fabricating venturis for engine muffler and other applications.

It is yet another object of the invention to provide a venturi of unusual configuration suitable for use in engine muffler and other applications.

It is yet another object of the invention to provide a metal venturi which is more easily fabricated.

SUMMARY OF THE INVENTION

These and other objects are each satisfied by one or more of the major aspects of this invention.

In one major aspect, the invention is a method for forming venturis from lengths of tube having rounded sides by permanently inwardly deforming two opposing sides of the tube along at least a portion of its length between the ends such that the two sides first converge towards one another and then diverge along this portion of the tube length. Importantly, the remainder of the tube wall along this portion of its length is allowed to move outwardly in reaction to the inward deflection of the aforesaid two opposing sides. The converging and diverging sides form a first chamber and a second chamber each converging on a central constriction or throat therebetween.

According to one important feature of this aspect of the invention, the two opposing tube sides are permanently deformed by effecting substantially identical inward flow of the two opposing sides, at least along the aforesaid portion of the length of the tube between the ends. If the original tube was symmetric with respect to a central longitudinal plane between the two opposing sides, such permanent deformation will result in a venturi symmetric along this plane. Equally deforming the two sides also minimizes the maximum stress to which the tube is subjected by apportioning the stress needed to achieve the necessary deflection over a greater portion of the tube surface.

According to yet another important feature of this aspect of this invention, the step of permanently inwardly deforming the two opposing sides of the tube is accomplished by applying pressure to the exterior of each of the two opposing sides of the tube while allowing the remainder of the tube along the aforesaid portion of its length, i.e. those portions of the tube wall connecting the two sides being pressured, to move outwardly. These remaining tube wall portions will typically bulge or bow outwardly and tighten in curvature under the influence of the deflection of the two opposing sides being pressured thereby further changing the transverse cross-sectional area of the tube.

Yet another important feature of this aspect of the invention is that it may be employed in the deformation of a ductile material tube, such as one formed of mild steel, by cold flowing the tube material under the application of external pressure along the two opposing sides of the tube.

According to yet another important feature of this aspect of this invention, one or both ends of the tube may be substantially blocked so as to prevent their deformation. This is useful where it is desirable to maintain the original configuration of the tube ends in order that they may be joined to other conduits leading to and from the venturi. It also assures that the tube ends are maintained at a known transverse cross-sectional geometry and area so that performance of the venturi may be more accurately predicted or assured. Additionally or alternatively, the center of the tube may be partially blocked, specifically where the venturi throat is to be formed, to limit the inward deformation of the two opposing tube sides. This may be desirable to assure specific dimensions of the venturi throat or to halt the deflection of the opposing tube sides at an appropriate separation where pressure is constantly applied to the opposing side walls regardless of their degree of deflection. The latter situation typically arises where a press lacking a travel stop is used to perform the deformation.

From another viewpoint the method is also practiced by simply flattening a pair of opposing sides of a rounded tube along the portion of the length of the tube between the tube ends while allowing the remainder of the tube between the flattening sides to move outwardly. The tube is flattened in increasing amounts from its ends toward a central location. Where a ductile tube is provided, the original transverse circumference of the tube at each point along its length is maintained during deformation.

Yet another aspect of the invention is apparatus for carrying out the aforesaid venturi forming methods.

A preferred embodiment of such apparatus comprises a pair of dies each having a forming face positioned opposite and along one of two opposing sides of the tube. The die faces are thus in proximal opposition with the tube positioned therebetween. The die faces are symmetric and each has a central peak or protrusion extending outwardly toward the proximal opposing tube surface. Each peak is formed by a pair of ramps, each ramp dropping away from the opposing tube surface as it extends away from the peak and along the tube length. The peaks are symmetrically located along a plane passing between the die faces and along the length of the tube and thus, each ramp of each die face opposes symmetrically a ramp of the opposing die face. Conventional means such as a conventional die press are provided for compressing the dies against two opposing sides of the tube. Each pair of symmetrically opposing ramps forms a reduction or expansion chamber while the opposing peaks form a throat or constriction in the tube.

According to other features of this embodiment, the ramps are formed with planar surfaces for reduced cost and ease of manufacture. Moreover, the die face protrusion may include a flattened top extending substantially parallel to the opposing, undeformed tube surface and between the ramps along the die face so as to provide a longitudinally elongated throat of substantially constant transverse cross-sectional area, which is desirable in muffler venturis.

According to this aspect of the invention, a venturi may also be formed from a tube having a rounded side wall by providing a first roller having an axis of rotation and circumferential tube forming surface about that axis traversing a portion of the length of the exterior of the tube with said circumferential roller surface, means for deflecting the circumferential surface into and out from the interior of the tube while the length of the exterior of the tube is being traversed by circumferential surface and support means contacting the exterior surface of the tube diametrically opposed to the tube wall being traversed by the roller for supporting the tube and resisting its movement when being deformed by the roller.

According to one important feature of this aspect of the invention, the means for deflecting the circumferential surface of the roller is a cam lobe protruding radially from the roller axis. Alternatively, the surface of a roller can be deflected by moving the rotational axis of the roller towards and away from the tube.

According to yet another important feature of this aspect of the invention, a second roller is provided to support the exterior of the tube diametrically opposite the surface being contacted by the first roller. The second roller also has a circumferential surface contacting the tube.

In yet another embodiment, two rollers of substantially identical size and shape are provided each having a substantially identical cam lobe. The apparatus is further provided with means for rotating the rollers in unison such that the cam lobes of the two rollers proximally oppose one another during each rotation of the rollers. Where a pair of cam rollers are provided, the separation between the two roller axes is such that the closest approaching points of the circumferential roller surfaces are spaced a distance less than the original tube diameter when the cam lobes are in proximal opposition.

The described die and roller apparatus are particularly suited for cold forming ductile metal thin wall tubing but may also be heated for deforming tubes of thermoplastic or other heat sensitive material.

Lastly, the invention also comprises a venturi of unusual configuration which is easily fabricated in a single step from a single length of hollow rounded tube. The venturi has at one end an inlet through which fluid enters the venturi and at the remaining end an outlet through which fluid exits the venturi. Between the inlet and outlet is located a throat or constriction, a reduction chamber connecting the inlet with the throat and an expansion chamber connecting the throat with the outlet. The venturi is formed by deflecting inwardly two opposing sides of the tube while allowing the remainder of the tube wall between the deflected sides to move outwardly thereby changing the transverse cross-sectional area of the tube. At each point along its central longitudinal axis, the venturi has a minor axis passing normally through the central longitudinal axis and the two closest opposing points of the tube wall at that point. Similarly, at each point along its central longitudinal axis, the venturi has a major axis also passing normally through the central longitudinal axis and the two most distantly opposing points of the tube wall at that point. Since the total circumference of the tube does not vary along its length and since the throat is most deformed, the throat has a minor axis which is shorter than any other minor axis of the venturi. The throat also has a major axis greater than any other major axis of the venturi. The reduction chamber is defined by minor axes, gradually varying from the minor axis of the inlet to the throat minor axis, and major axes varying from the inlet major axis to the major axis of the throat. Similarly the minor axes of the expansion chamber vary from the throat minor axis to the outlet minor axis, and its major axes vary from the throat major axis to the outlet major axis.

Lastly, according to another feature of this aspect of the invention the venturi throat and the reduction and expansion chambers are formed by compressing to varying degrees only two opposing rounded sections of the tube wall. Thus, a venturi according to this invention has a center line extending longitudinally therethrough, a reduction chamber in which only two opposing wall sections converge towards the center line as the chamber extends from an inlet to a throat and an expansion chamber in which only two opposing wall sections diverge from the center line as that chamber extends from the throat to an outlet.

BRIEF DESCRIPTION OF THE DRAWINGS

The various aspects of the invention will be better understood with reference to the accompanying drawings in which;

FIGS. 1 and 1*a* are end and side sectioned views, respectively, of a blank tube before forming;

FIG. 13 is a view of an alternative method of forming the venturi corresponding to FIG. 2;

FIG. 14 shows an alternative cam-forming method;

FIG. 14*a* is a plan view of a cam roller 4;

FIG. 15 is a perspective view of yet another version of the venturi formed according to the invention; and FIG. 16 is a cross-sectional view along the line 16—16 of FIG. 15.

DETAILED DESCRIPTION OF THE INVENTION

It will be appreciated that as a circle provides the maximum area of any plane figure having a given periphery, deformation of a cylindrical tube inwardly will decrease the cross-sectional area of the tube while not requiring change in the circumference. Hence, deformation of the proper kind is all that is required to form venturi tubes, cutting and metal removing operations as well as welding or other joining operations being avoided, and accordingly provision of such proper deformation methods is a primary aspect of this invention. The following discussion outlines several ways in which this object can be achieved.

Figure 1:
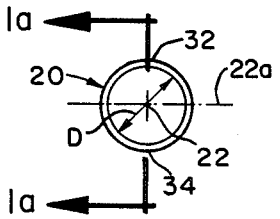

FIGS. 1 and 1*a* depict diagrammatically in end and side sectioned views a substantially circular tube 20 having a central longitudinal axis 22 and a uniform diameter D along its length. The tube is preferably of a ductile material that may be deflected and permanently deformed under pressure without excessive stretching or tearing. For muffler venturi fabrication, the tube may be made from a mild steel with or without an aluminum coating thereon for corrosion resistance. Typically, the tube will be several inches in diameter and formed from relatively thin (i.e. typically 0.050 inch thick) stock conventionally used in muffler fabrication. The tube may be seamless as depicted or formed with a longitudinally extending seam. The tube 20 has a pair of open ends 52 and 54 and a pair of diametrically opposed sides 32 and 34 which will be inwardly formed to fabricate the venturi. The notation 20 will be used to identify an undeformed tube while the notation 20*a* will be used to identify the tube after deformation, i.e. the formed venturi. Plane 22*a* a plane of symmetry between the sides 32 and 34 and along the axis 22.

Figure 2A:
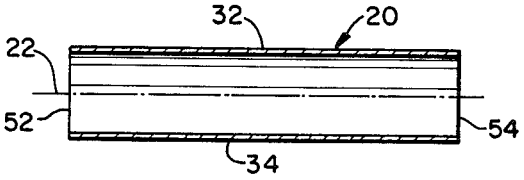
FIGS. 2 through 3*a* depict diagrammatically the apparatus and steps employed in forming a venturi according to the present invention using a pair of opposing dies.
Figure 2A:
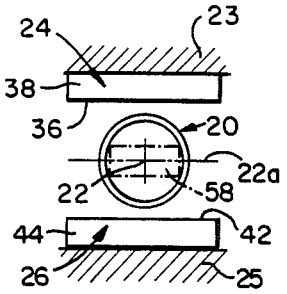
Figure 2:
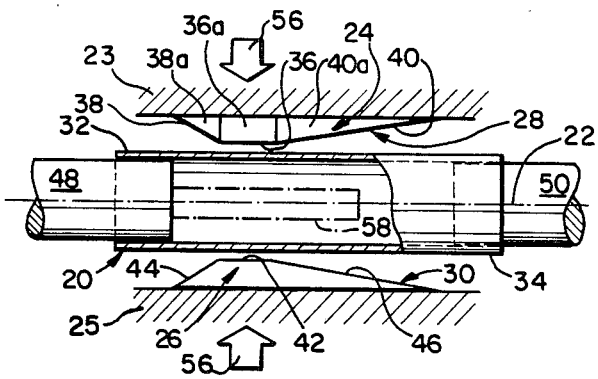

FIGS. 2 and 2*a* depict side and end views respectively, of the tube 20 of FIGS. 1 and 1*a* centrally positioned between proximally opposing faces 28 and 30 of a pair of opposing dies 24 and 26, respectively. The tube 20 is supported by a pair of plugs 48 and 50 inserted into and substantially blocking the open tube ends 52 and 54, respectively. An optionally provided tongue 58 extends from the plug 48 symmetrically along the central tube axis 22. FIG. 2*a* is an end view of the tube 20 and dies 24 and 26, omitting theplugs 48 and 50 but indicating the tongue 58 in phantom. The faces 28 and 30 (FIG. 2 only) proximally oppose sides 32 and 34, respectively, of the tube 20. Where the tube 20 is seamed, it is suggested that the seamed side be one of the two sides 32 and 34 facing the dies 24 and 26. The dies 24 and 26 are fixed by suitable means to jaws 23 and 25 (indicated by shading) of a conventional double acting press (not itself depicted) or to other conventional means by which the dies 24 and 26 may be closed together under pressure upon opposing outer sides 32 and 34 of the tube 20.

The two die faces 28 and 30 are symmetric to one another and symmetrically positioned with respect to the central longitudinal axis 22 and plane 22*a* of the tube 20. Each face 28 and 30 peaks or protrudes outwardly toward the proximal opposing outer side 32 and 34, respectively, of the tube 20. The sides of the peak are provided by a first ramp 38 and second ramp 40 which are connected by an elongated throat forming surface 36 substantially parallel to the plane 22*a*. The second die face 30 has first ramp 44, second ramp 46 and another elongated throat forming surface 42 symmetric to the corresponding first ramp 38, second ramp 40 and surface 36 of the first die face 28. Each die may be provided in a single piece as is indicated by the second die 26 or may be assembled from component pieces 36*a*, 38*a*, and 40*a*, as indicated by the first die 24, so as to allow easy variation of the die surface for fabricating venturis of different configurations. It will be appreciated that, if desired, the elongated throat forming surfaces 36 and 42 may be omitted from the dies 24 and 26 so as to provide a sharply constricting throat. Also, the surfaces 36 and 42 may be inclined toward one another rather than held parallel so as to provide a more sharply or less sharply constricting elongated throat after the reduction chamber or more sharply or less sharply expanding elongated throat before the expansion chamber, if such a venturi is desired. It will further be appreciated that any or all of the surfaces 36 through 46 may be curved either along the length of the tube 20 and dies 24 and 26 (i.e., along the plane of FIG. 2) or, if desired, across the die face 28 and/or 30 (i.e., into the plane of FIG. 2). However, planar ramp and elongated throat forming surfaces have been found entirely satisfactory in fabricating suitable muffler venturis and are much easier and less expensive to fabricate than die pieces provided with curving surfaces.

The plugs 48 and 50 are preferably provided substantially filling the open tube ends 52 and 54, respectively, so as to maintain their original cross-sectional shape and size. This is particularly useful in muffler fabrication where one end of the venturi also serves as an inlet or outlet tube of the muffler and is thus connected to an exhaust pipe. The plugs 48 and 50 may also be used to move the tube 20 into and out from between the dies 24 and 26, before and after the forming step.

By providing a pair of opposing dies 24 and 26 with symmetric opposing faces 28 and 30, the strain imposed upon the tube 20 during the deforming process is more evenly distributed about the tube. Moreover as the tube 20 and die faces 28 and 30 are symmetric about the plane 22*a* passing through the central longitudinal axis 22, the resulting venturi is also symmetric about that plane. Alternatively, the second die 26 could be replaced by some other suitable support surface contacting the outer side 34, such as a planar support surface or a surface convex with respect to the central longitudinal axis 22 of the tube 20 to form a less symmetric venturi which may, nonetheless be useful for some other applications.

After the tube 20 has been positioned between the faces 28 and 30 as described, the dies 24 and 26 are compressed in the direction indicated by the arrows 56. If desired, a tongue 58 may be provided within the tube 20 to stop the inward motion of the dies 24 and 26 during the compression step or a stop used with the die press or other means used to compress the dies.

Figure 3A:
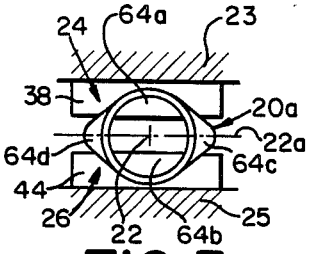
Figure 3:
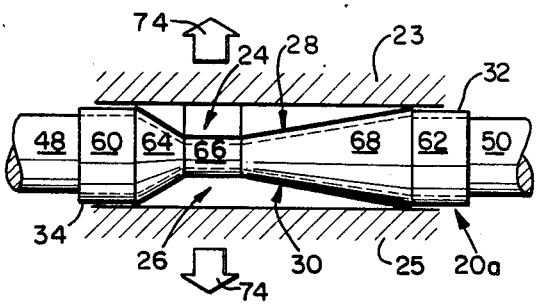
Figure 4:
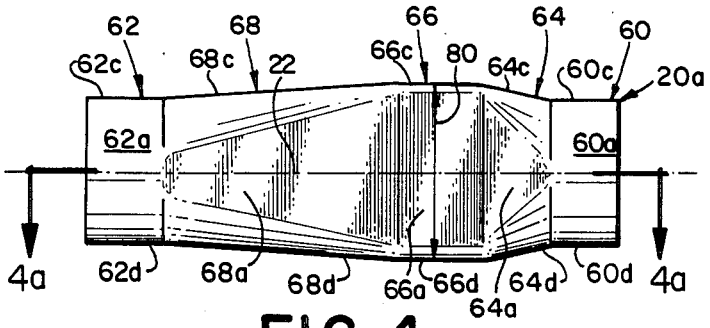
FIGS. 4, 4*a* and 4*b* are an overhead, a sectioned side, and a frontal end diagrammatic view, respectively, of the venturi formed by either of the processes and apparatus depicted in FIGS. 2 through 3*a* and FIGS. 5 through 7.
Figure 4A:
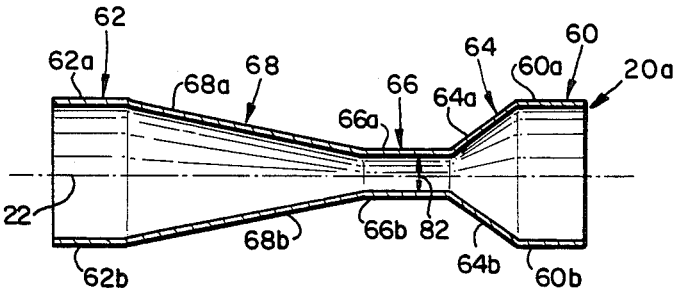
Figure 4B:
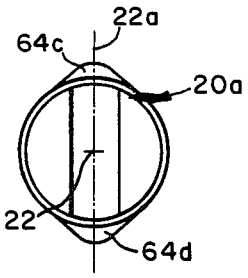

In FIGS. 3 and 3*a*, the dies 24 and 26 of FIGS. 2 and 2*a* are depicted in a compressed state inwardly deforming the two opposing outer sides 32 and 34 of the tube 20 so as to form a venturi 20*a*, which is illustrated separately in FIGS. 4, 4*a*, and 4*b*. The plugs 48 and 50 have maintained the original transverse cross-sectional circumference and area of the open ends 52 and 54 of the tube 20 so as to form an inlet 60 and an outlet 62, respectively, of the venturi 20*a*. The first ramps 38 and 44 have formed a reduction chamber 64. The faces 36 and 42 have formed an elongated throat or constriction section 66 which at one end is connected to the inlet 60 by means of the reduction chamber 64. At its opposing end, the throat 66 is connected to the outlet 62 by an expansion chamber 68 formed between the second ramps 40 and 46. After permanent deformation of the opposing sides 32 and 34, the dies 24 and 26 are retracted from the now formed venturi 20*a* in the manner depicted by the arrows 74.

As the original tube 20 was symmetric about its central longitudinal axis 22 and located with its central plane 22*a* symmetrically positioned between the symmetric die faces 28 and 30, the tube 20 is substantially symmetrically deformed by equal compression of the side walls 32 and 34 by the faces 28 and 30. The venturi 20*a* thus formed is also symmetric about the plane 22*a*. If the tube 20 had been symmetric only about the plane 22*a*, or only about a plane normal to the plane 22*a* the resulting venturi would also be substantially symmetric about the plane 22*a* or normal plane.

As can be seen in the various views of the venturi 20*a* in FIGS. 4, 4*a*, and 4*b* the inlet 60 and outlet 62 maintain the original circular cross-sectional geometry and diameter D of the tube 20. The reduction chamber 64 is formed by a pair of opposing planar sides 64*a* and 64*b* converging toward one another as they extend from the inlet 60 to the throat section 66. The throat section 66 and expansion chamber 68 are similarly formed from opposing planar wall sections 66*a* and 66*b*, 68*a* and 68*b*, respectively. Curving sections of walls 66*c* and 66*d* connect the two planar wall sections 66*a* and 66*b* of the throat 66. Similarly curving wall section 64*c* and 64*d* connect planar sections 64*a* and 64*b* of the reduction chamber 64 and curving wall sections 68*c* and 68*d* connect the planar wall sections 68*a* and 68*b* of the expansion chamber 68. The sections of the tube 20 between the opposing compressed surfaces 32 and 34 (i.e., sides 64*c*, 64*d*, 66*c*, 66*d*, 68*c* and 68*d* between sides 64*a*, 64*b*, 66*a*, 66*b*, 68*a* and 68*b*) have bulged outwardly to varying degrees depending upon the extent of the inward deflection of the walls 32 and 34 and have formed what may be described as a racetrack cross-section having a pair of opposing planar sides connected by a pair of symmetrically curved sides.

The cross-sectional areas of the reduction chamber 64, throat 66 and expansion chamber 68 are better described in terms of a major axis 80 and a minor axis 82. A major axis 80 extends normally through the central longitudinal axis 22 between the two most widely separated points of opposing tube wall at that point along the length of the venturi 20*a*. The minor axis 82 similarly extends normally through the central longitudinal axis 22*a* between the two closest approaching points of opposing tube wall at that point along the length of the venturi 20*a*. Thus, in the depicted venturi 20*a*, the throat is defined by that portion of the venturi having the smallest minor axis 82 and greatest major axis 80. The reduction chamber 64 is defined by that portion of the venturi 20*a* having minor axes 82 shorter than the uniform diameter D of the inlet 60 but greater than the minor axis of the throat 66 while having major axes 80 greater than the uniform diameter D of the inlet 60 but less than the major axis of the throat 66. The expansion chamber 68 is similarly defined with respect to the major and minor axes of the throat 66 and the uniform diameter D of the outlet 62. Viewed another way, the major axis 80 of the venturi 20*a* first increases to a maximum value at the throat 66 and then decreases as the venturi 20*a* is traversed along the central longitudinal axis 22 from either end while the minor axis 82 diminishes to a minimum value at the throat and then increases while the length of the axis 22 is being traversed.

An elongated throat 66 of constant cross-sectional area is preferred for muffler applications. It will also be appreciated that for other applications an abrupt throat could be formed by the direct intersection of the reduction chamber 64 and expansion chamber 68 planar surfaces (i.e., meeting of 64*a* with 68*a* and of 64*b* with 68*b*). Similarly non-parallel planar surfaces could have been provided in the throat to form a more abrupt or gradual constriction after the reduction chamber or more gradual or immediate expansion prior to the expansion chamber.

Figure 5:
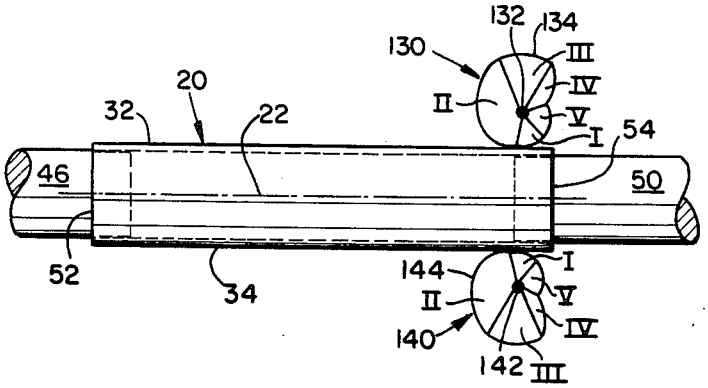
FIGS. 5 through 7 depict diagrammatically the apparatus and steps employed in forming a venturi according to the present invention using a pair of opposing cam rollers.
Figure 6:
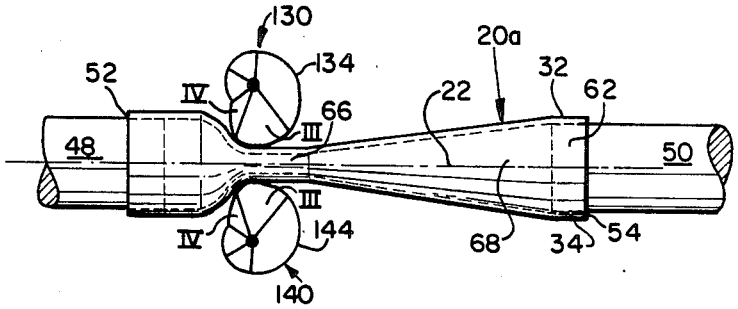
Figure 7:
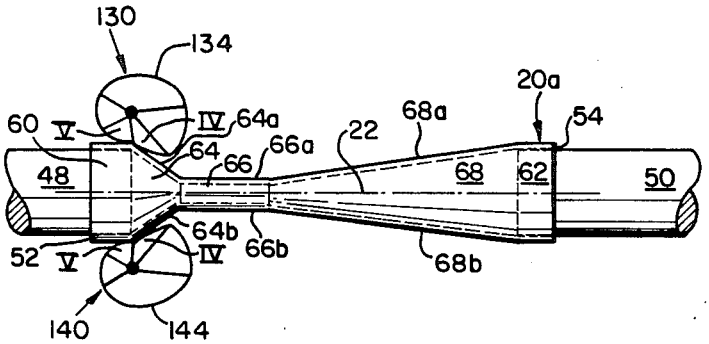
Figure 8:
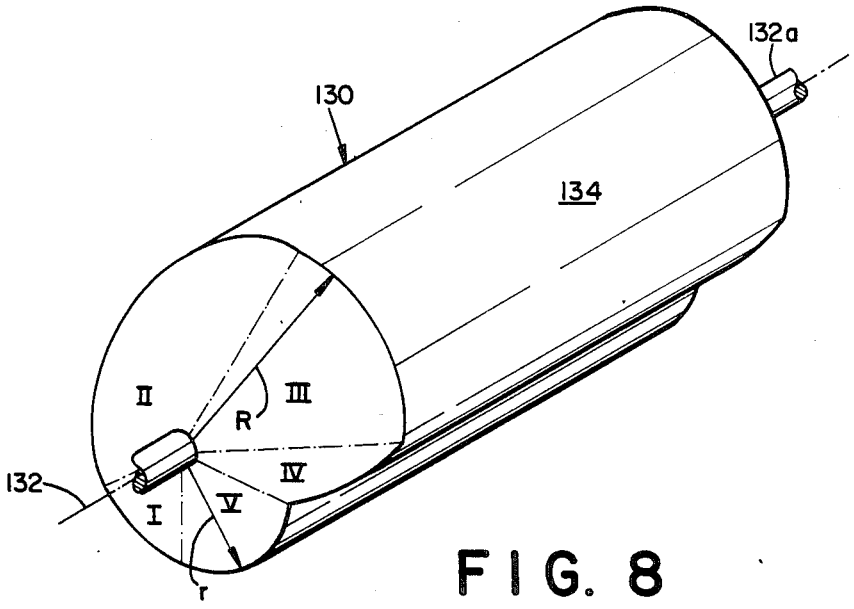
FIG. 8 is a perspective diagrammatic view of one of the rollers of FIGS. 5 through 7.

The venturi 20*a* of FIGS. 4 through 4*b* can also be formed through the use of rollers, an embodiment of which is depicted in various steps of operation in FIGS. 5 through 7. Depicted in those figures are a pair of identical eccentric rollers 130 and 140 each having an axis of rotation 132 and 142, respectively, and a circumferential surface 134 and 144 about the axis of rotation 132 and 142, respectively. The circular tube 20 of FIGS. 1 and 1*a* is again positioned between the rollers 130 and 140 with two diametrically opposed surfaces 32 and 34 being contacted by the circumferential surfaces 134 and 144. Again, if the tube is longitudinally seamed, the seam should form one of the surfaces 32 or 34 contacted by a roller 130 or 140. The roller 140 is a mirror image of the roller 130 which is shown in perspective with an axle 132*a* through its axis of rotation 132 in FIG. 8. The rollers 130 and 140 are positioned with their axes of rotation 132 and 142 parallel to one another and forming a plane perpendicular to the center line 22 of the tube 20, previously depicted in FIG. 1. Deformation of the tube 20 is accomplished by deflecting the circumferential surfaces 134 and 144 of the rollers 130 and 140 toward and away from the interior of the tube 20 by the provision of eccentricity to the rollers 130 and 140.

To better understand the nature of the rollers 130 and 140, the rollers 130 and 140 in FIGS. 5 through 8 have each had its transverse cross-sectional area broken into 5 sectors, I to V, thereby comparably dividing the circumferential surface 134 or 144 into 5 sectors. It will be appreciated that the following description of the roller 130 applies comparably to the roller 140. In the depicted embodiment, the roller 130 has initially contacted the end 54 of the tube 20 at a point dividing the sector I from the sector V and, as shown, has traversed the length of sector I of the circumferential surface 134. The roller 130 is rotated in a counter-clockwise direction (140 in a clockwise direction) so that circumferential surface 134 of the roller 130 traverses the length of the side 32 of the tube from the end 54 to end 52. The sector I has a radius r equal to the spacing between the axis 132 and the proximal opposing side 32 of the tube 20 in its undeformed state. Thus the roller 130 "walks along" the upper surface 32 of the tube 20 without causing an inward deformation. At sector II the radius of the roller 130 is increased linearly to a maximum value R at the interface between sectors II and III. That maximum radius R is maintained across the sector III. The deformation of the tube 20 in FIG. 5, accomplished by the sectors II and III, is shown in FIG. 6 where a venturi shape 20*a* is evident. The increasing radius of sector II has caused the linearly increasing protrusion of the circumferential surface 134 resulting in an increasing inward deformation of the tube 20 and the formation of a planar surface 68*a* converging on the center line 22 of the venturi shape 20*a*. Before the upper surface 32 has been deflected to intersect the center line 22, the maximum radius R of the roller is reached at the interface between sectors II and III and that radius is maintained constant across the sector III so as to form a planar wall 66*a* substantially parallel to the center line 22. In sector IV, the radius of the roller is reduced from its maximum value R to the original radius r of sector I (i.e., the separation distance between the axis 132 and the end of the undeformed tube end 54 opposite sector I). This results in the formation of yet another planar surface 64*a* diverging from the center line 22 to the original undeformed tube end configuration. Sector V again has a radius r equal to the distance between the axis of rotation 132 and the surface 32 of the undeformed ends 52 and 54 of the tube 20. The roller 130 "walks off" the end 52 of the now fully formed venturi 20*a* without deforming it. Sectors II, III, and IV form a cam lobe on the rollers 130 and 140 in which the radius of the rollers increase from a minimum value, r, to a maximum value, R, and back to the minimal value r again. The second opposing roller 140 has accomplished a symmetrical deformation of the opposing outer side 34 of the original tube 20 forming planar walls 64*b*, 66*b*, 68*b* symmetric to the walls 64*a*, 66*a*, and 68*a*, as perhaps best shown by FIG. 7. The venturi 20*a* formed by the process depicted in FIGS. 5 through 7 is in all respects identical to the venturi 20*a* of FIGS. 4 through 4*b*.

Although FIGS. 5 through 7 indicate a lateral movement of the rollers 130 and 140 along a stationary tube 20, the rollers 130 and 140 may be held on a stationary axis and the tube 20 moved between them during their rotation. Preferably, suitable means such as gearing is also provided to assure the synchronous rotation of the rollers 130 and 140 and the synchronous intersection of each sector I through V of the circumferences on diametrically opposed portions of the outer sides 32 and 34 of the tube 20 so as to form a symmetric venturi 20*a*. The rollers may be driven so as to pull the tube 20 between them or merely linked for synchronous rotation and the tube 20 forced between them causing them to rotate.

As was the case with the opposing die apparatus depicted in FIGS. 2 and 3, one of the two rollers 130 or 140 can be replaced by an opposing support surface contacting the opposing side 34 or 32, respectively. The greater deformation in this case will occur on the side contacted by the remaining roller although some inward deformation of the side contacting the support surface would also be expected.

Additionally, instead of providing a pair of opposing eccentric rollers, a pair of opposing circular rollers may be provided and the varying deformation along opposing sides 32 and 34 of a tube 20 accomplished by varying the separation distance between the axes of rotation of the opposing circular rollers. Roller separation can be closely controlled by any of a large number of techniques that are familiar to those in the art including modern numerical controllers directed by endless tapes or small computers.

The method of the invention has now been described in several alternative embodiments. Common to each is that deformation of the precursor tube takes place from two opposite sides. The tube then bulges outwardly in the perpendicular directions. In the methods heretofore described, no control of this deformation has been provided. It should be appreciated that control of such bulging deformation might sometimes be useful, and this is within the scope of the invention.

Such control could easily be accomplished, for example in the stamping embodiment, by providing on either side of the tube to be deformed substantially planar, fixed die blocks with their faces opposed to one another, so that as the tube bulged outwardly, the bulging portions would contact the die faces, so that the end result would be a venturi of generally rectangular cross-section. The same result could be achieved with roller dies, also on either side of the tube rotating about axes perpendicular to the rollers 130 and 140 of FIGS. 5–7. Typically, these could have varying radii and could rotate in synchronism with the rollers 130 and 140 to control the outward bulging of the tube.

FIGS. 13, 14 and 14A illustrate these two alternatives. FIG. 13 corresponds generally to FIG. 3A. In addition to the upper and lower dies 24 and 26, additional die members 1 and 2 are provided which limit the outward deformation of the tube such that it has a substantially rectangular cross-section as indicated at 3. The same result could be achieved if a pair of additional rollers 4 were added to the roller die scheme shown in FIGS. 5–7, as shown in FIG. 14. FIG. 14A shows an end view of one such roller, which is essentially circular with a portion 4*a* of slightly reduced radius to form the smaller sides of a generally rectangular throat portion of the venturi 3. However, if it were only desired to limit the outermost bulging of the tube, the rollers could be circular and spaced from the center of the tube so as to only contact the bulged throat section; or they could be eccentrically mounted cylinders. The end result is substantially the same as in the roller embodiment of FIGS. 5–7 except that as noted the cross-section of the tube is substantially rectangular due to the additional control exerted by the extra pair of rollers 4.

FIG. 15 shows yet another possible way in which a venturi as for a muffler can be made by deformation of a substantially round tube. Here the dies ar shaped such as to generate substantially flat webs of material 5 along the two sides of the venturi when it is formed. A cross-sectional view taken along the line 16—16 of FIG. 15 appears as FIG. 16 and shows how the webs 5 are formed by compression of the tube. Dies to make this venturi are well within the skill of the art once the concept expressed in 15 and 16 has been explained.

All of the above additional embodiments of the invention described by FIGS. 13–16 have in common that the overall circumference of the tube does not vary while its effective internal cross-sectional area is reduced due to the deformation. The embodiment shown in FIGS. 13 and 14 additionally result in a tube having a substantially rectangular cross-sectional shape at its central throat portion. The embodiment shown in FIGS. 15 and 16 however has doubled over web members 5 on either side of the central throat which may be substantially round as shown but again has a greatly reduced cross-sectional area as compared with the undeformed tube.

Figure 9:
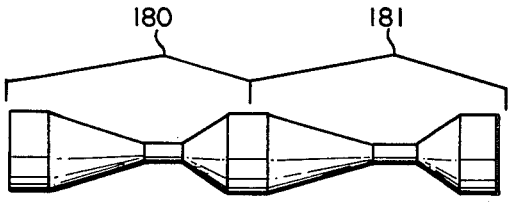
FIG. 9 depicts diagrammatically a series of venturis formed in a single length of tube by the present invention.

It will further be appreciated that the previously described method and apparatus can be modified so as to form a series of venturis along a single tube, as is illustrated in FIG. 9. Thus, for example, the apparatus depicted in FIGS. 2 and 3 may be applied sequentially two or more times to a single length of tubing to form identical venturis 180 and 181 or the dies modified so as to provide two or more protrusions or peaks and thus two or more consecutive venturis 180 and 181. Similarly, the rollers 130 and 140 of FIGS. 5 through 7 may be rotated two or more times along a single length of tubing to form identical, sequential venturis or a larger roller with two or more cam lobe surfaces provided to form a series of venturis in a single tube. Consecutive venturi tubes may be used directly as shown in FIG. 9 or it may prove cost effective in certain manufacturing applications to form a series of identical venturis along a single tube in a single deforming operation and then cut or otherwise separate the individual venturis for subsequent use.

Figure 10A:
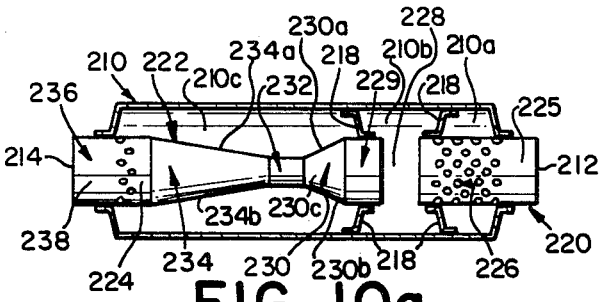
FIGS. 10 and 10*a* are end and side partially-sectioned views, respectively, of a first muffler embodiment incorporating the subject venturis.
Figure 10:
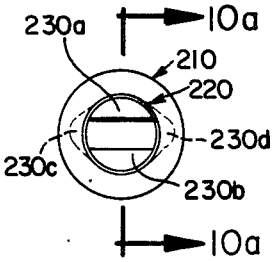
Figure 11A:
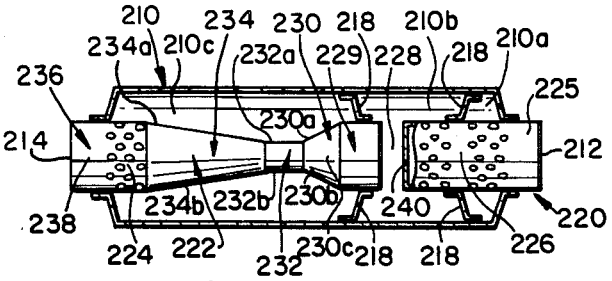
FIGS. 11 and 11*a* are end and side partially-sectioned views, respectively, of a second muffler embodiment incorporating the subject venturis.
Figure 11:
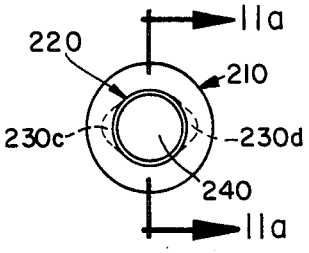
Figure 12A:
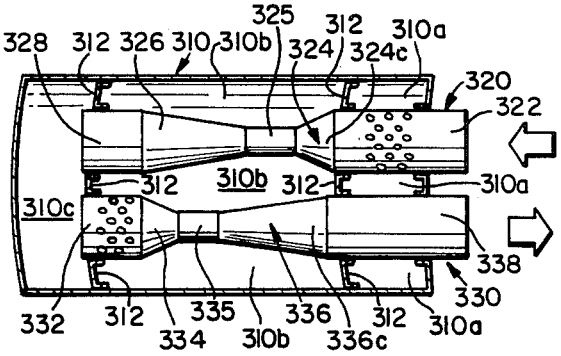
FIGS. 12 and 12*a* are end and side partially-sectioned views, respectively, of a third muffler embodiment incorporating the subject venturis.
Figure 12:
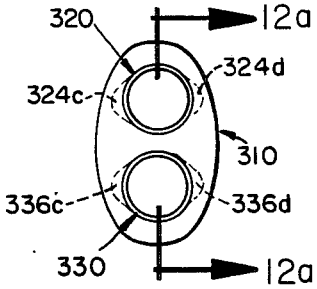

FIGS. 10, 11, and 12 are end diagrammatic views of two muffler embodiments and a third envisioned muffler embodiment respectively, incorporating venturis of the present invention. FIGS. 10*a*, 11*a*, and 12*a* are partially side-sectioned diagrammatic views of the same three mufflers, respectively. Extensive background regarding muffler construction and the employment of venturis in mufflers is set forth in the aforesaid U.S. Pat. No. 4,361,206 of Tsai, assigned to the assignee of this application and incorporated by reference herein.

Referring now to FIGS. 10 and 10*a*, there is shown in end and side views respectively, a first muffler comprising a generally cylindrical housing 210 having an inlet 212 at one end and an outlet 214 at its opposing end. In FIG. 10*a*, the housing 210 is sectioned to reveal a plurality of baffles 218 which support a generally tubular inner structure which comprises in the embodiments of the muffler shown in these two figures, an inlet tube 220 and a flattened venturi 222 of the present invention, all of which are preferably axially aligned for substantially straight-through exhaust gas flow, so as to avoid the build up of back pressure. The baffles 218 also divide the housing 210 into a series of compartments 210*a*, 210*b* and 210*c*.

The inlet tube 220 comprises a first section 225 adapted to be connected to an exhaust pipe and a second section 226 which is generally perforate, the perforations typically extending substantially all the way around the tube. The use and effect of perforations is known in the art and further described in the aforesaid Tsai patent. The inlet tube 220 is separated by a gap indicated at 228 from the next section of the muffler, the venturi 222. The perforations of the inlet tube 220 induce a phase change and attenuation of the exhaust gas noise. The gap 228 causes a further phase change and attenuation. The venturi 222 is like the venturi 20*a* of FIGS. 4—4*b* and comprises an inlet 229 having a substantially circular cross-section of constant area substantially equal to that of the inlet tube 220 along its length. The inlet 229 leads into a converging reduction chamber 230 having a shape corresponding to the reduction chamber 64 of the venturi 20*a* of FIGS. 4—4*b* formed by a pair of opposed planar surfaces 230*a*, 230*b* converging toward the center of the venturi 222 and connected by a pair of curved, bulging wall sections 230*c* and 230*d*, the latter wall sections also being indicated in phantom in FIG. 10. The walls 230*a*, 230*b*, 230*c* and 230*d* provide a continuously diminishing cross-sectional area to the reduction chamber 230 as it extends away from the constant cross-sectional area inlet 229. It will be appreciated that the cross-section of the venturi 222 may be more rounded than that depicted in FIGS. 4—4*b* where a stiffer tube material is used to form the venturi or may be non-symmetric if the tube is deformed primarily along one side, as would be expected where a single die or roller was used. The reduction chamber 230 communicates with an elongated throat section 232. It is preferred that the throat section have a constant cross-sectional area less than the cross-sectional area of the inlet 229 or reduction chamber 230. It is believed that the reduction chamber 230 and throat section 232 permit an efficient and well-defined reflection of at least part of the incoming sound wave at the interface between the reduction chamber 230 and throat section 232. Moving now along the length of the venturi 222, an expansion chamber 234 connects the throat 232 with an outlet section 236 having a substantially circular transverse cross-sectional area substantially equal to that of the inlet 229 and inlet tube 220. The cross-sectional area of the expansion chamber 234 gradually increases from about that of the throat section 232 to about that of the outlet section 236 as the compressed sidewalls 234*a* and 234*b* of the chamber 234 gradually diverge. The outlet section 236 comprises a length 224 within the housing 210 which is perforate about its circumference for at least a portion of that length and a portion 238 outside the housing 210 forming the muffler outlet 214. It is preferred that both the throat section 232 and expansion chamber 234 are as long as possible given the constraints of the overall package so as to increase attenuation without loss of efficiency due to increased back pressure. Moreover, it is preferred that the transverse cross-sectional area of the throat section 232 be significantly less than that of the inlet 229 and outlet 236. Throat sections 232 having transverse cross-sectional areas of about 40% of the area of the inlet 229 and outlet 236 have been successfully employed. It will be appreciated that a trade-off will exist between noise attenuation and back pressure through the muffler and that the geometry of the muffler and its venturi will be varied to optimize the muffler to meet particular operating requirements. As is common practice, all parts of the muffler may be made of a mild steel with or without aluminum coating thereon for corrosion resistance. Other conventional muffler fabricating practices may be employed including the use of a double layer outer housing 210 and/or the inclusion of a dampening material between the two layers for sound and/or heat insulation.

An embodiment of the flattened venturi muffler depicted in FIGS. 10 and 10*a* was tested for performance with a Cummins engine model NTC"350. The muffler housing had a length of 45", an inlet tube 220 approximately 5" in diameter having a perforate section 5-¾" long extending along the first chamber 210*a* to the first set of baffles 218 and an additional 5" extending beyond the first chamber 210*a* and perforate layer into the middle chamber 210*b*. The venturi 222 was 32-½" long having a 4" long inlet section, a 2-½" long reduction chamber connected to a 4-½" long throat section 1-½" wide along its minor 25 axis followed by a 17-½" long expansion chamber and 4" long outlet section. Two rows of perforations were provided around the outlet section proximal to the expansion chamber. The venturi inlet and outlet were also about 5" in diameter. The housing had a 10" diameter. The performance of this embodiment with the aforesaid Cummins engine operated at a speed of approximately 2100 RP is set forth in Table I. The muffler was operated in both a single exhaust mode (i.e., one muffler receiving all exhaust gases produced by the engine) and in a dual exhaust mode (i.e., two identical mufflers each receiving one-half of the exhaust gases generated by the engine).

TABLE I

| TYPE EXHAUST SYSTEM | NOISE LEVEL dB(A) | BACK PRESSURE (Inches - Hg) |
|---|---|---|
| Single | 82.0 | 0.9/0.5 |
| Dual | 79.2 | 0.6/0.2 |

A second muffler embodiment is depicted in FIGS. 11 and 11*a* and diverges only slightly from the embodiment depicted in FIGS. 10 and 10*a*. The same reference numbers have been used to designate parts comparable to those of the embodiment in FIGS. 10 and 10*a*. The second muffler in FIGS. 11 and 11*a* differs from the first muffler of FIGS. 10 and 10*a* in the following ways. The first chamber 210*a* of the housing 210 is somewhat smaller and the perforations along the constant diameter, cylindrical inlet tube 220 extend along the length of that tube within the first chamber 210*a* and second chamber 210*b*. The expansion chamber 234 of the FIGS. 11 and ll*a* embodiment is somewhat shorter than that of the FIGS. 10 and 10*a* embodiment and allows the use of a longer cylindrical outlet section of constant diameter 224 within the housing with perforations along a greater portion of the length of the outlet section 224 within the housing. Lastly, the left end of the perforate section 226 of the inlet tube 220 has been partially broken away to reveal a barrier 240 inserted across the cross-section of the tube 220 near its left end to block the tube 220 and force gases entering the tube 220 to pass through the perforations into the first and second chambers 210*a* and 210*b*. The first chamber 2100 acts as a resonator to induce an attenuation and phase change of the exhaust gas noise. A commercially available round venturi truck muffler, supplied by another manufacturer, was compared with an embodiment of the flattened venturi muffler depicted in FIGS. 11 and 11*a* having the following dimensions. The muffler housing 210 was approximately 10" in diameter and 45" long. The circular inlet tube 220 was approximately 5" in diameter and 15-½" long, 12-½" of which were within the housing spanning the first and part of the second chambers 210*a* and 210*b*. The first chamber 210*a* was approximately 4-½" long and thus approximately 8" of the inlet tube 220 extended into the second housing chamber 210*b*. The last 10-½" of the inlet tube 220 spanning the first and second chambers 210*a* and 210*b* were perforated. A one piece venturi/outlet tube 222, 32-½" long was provided. A 2" long, 5" diameter circular inlet section 229 extended into the second housing chamber 210*b*. The reduction chamber was approximately 2-½" long and was followed by a 2-½" long throat having a uniform minor axis of 1-¼". The throat was followed by a 16-3/4" long expansion chamber expanding linearly to an approximately 5" diameter cylindrical outlet section 236 of the venturi 8-¾" long. The section 224 of the outlet within the housing 210 was entirely within the third chamber 210*c* and was 5-¾" long. The section 224 was perforated substantially along that entire length. The remainder 238 of the outlet section 236 protruding from the housing 210 was about 3" long and formed the muffler outlet 214. A comparison of the performance of this muffler embodiment was made with a commercially available muffler having a circularly concentric venturi with nearly the same number of barriers and tube lengths as the embodiment depicted in FIGS. 11 and ll*a*, but in which at least some of the exhaust gases bypassed the venturi within the housing. The results of the comparison which was made using the aforesaid Cummins NTC-350 engine operated at about 2100 RPM in a single exhaust system mode, are set forth in Table II.

TABLE II

| MUFFLER EMBODIMENT | NOISE LEVEL dB(A) | BACK PRESSURE (Inches - Hg) |
|---|---|---|
| Flattened venturi (FIGS. 11, 11a) | 74.5 | 2.8/2.5 |
| Commercial Muffler | 72.4 | 2.8/2.4 |

FIGS. 12 and 12*a* are end and partially sectioned side views, respectively, of yet a third envisioned embodiment of the muffler having an outer housing 310, a first venturi 320, a second venturi 330, and a plurality of baffles 312 between the housing 310 and venturis 320 and 330 dividing the interior of the housing about the venturis 320 and 330 into three chambers, 310*a*, 310*b* and 310*c*. Exhaust gas enters the inlet 322 of the venturi 320 which acts as the inlet of the muffler, passes through a reduction chamber 324, through an elongated throat 325 and through a more gently diffusing expansion chamber 326 to a constant diameter outlet 328 where the gas enters the third internal chamber 310*c* of the housing 310. The gas then enters a circular inlet 332 having the same diameter as the inlet 322 and outlet 328 of the first venturi 320. The gas passes through the inlet 332 to a reduction chamber 334 followed by an elongated throat 335 of constant reduced cross-sectional area followed itself by a more gently diffusing expansion chamber 336 increasing in cross-sectional area to an outlet section 338 having a circular cross-section of the same diameter as the inlets 322 and 332 and outlet 328. Exhaust gases exit the housing through the outlet 338. The first venturi 320 is perforated along the section of its inlet 322 within the first chamber 310*a* while the second venturi 330 is perforated along its inlet 332 within the second chamber 310*b*. Again, the venturis 320 and 330 are of the flattened configuration depicted in FIGS. 4—4*b*. Although shown to be of approximately the same diameter, the inlet and outlet sections 229 and 236 of FIGS. 10–11*a* may be of a different diameter than that of the inlet tube 220. Similarly, the venturis 320 and 330 of FIGS. 12 and 12*a* may be of different diameters.

As mentioned above, the formation of venturis not of circular cross-section from metal tubes by deformation is at least partially motivated by economic considerations. The most inexpensive method of forming a venturi having conical reducing and expanding sections jointed to a throat, all of which sections are circular in cross-section, involves swaging of circular tubes of diameter equal to the venturi inlet and outlet diameters. The cost of parts made this way was recently estimated to be some $11.72 each after tooling costs of $7,590 are incurred. Venturis of comparable dimensions made as discussed in connection with FIG. 13 can be made, it was estimated, for $8.21 each, and the tooling cost was estimated at $1,500. Clearly the savings are significant.

As can be seen from the above description, the invention has numerous aspects including the unusual flattened tube venturi configuration, as well as a method and apparatus for forming this type of venturi. It will be appreciated that while preferred and some other embodiments of the invention have been described, modifications and variations to one or more of the aspects will occur to those familiar with the art. Accordingly, it is submitted that the scope of the invention should not be defined by this disclosure, which is merely exemplary, but rather by the following claims.

What is claimed is:

1. A muffler for exhaust gases from an internal combustion engine comprising:
   a housing;
   an inlet into the housing;
   an outlet from the housing; and
   a venturi tube disposed within the housing, defining at least part of a passage for the exhaust gases through the housing between the inlet and outlet and having a centerline along the tube length and, at each point along the tube length in a plane normal to the centerline, a transverse cross-sectional area and a transverse wall circumference, the transverse cross-sectional areas of the venturi tube varying in size along at least a portion of the tube length and the transverse wall circumferences of the venturi tube being of a substantially uniform along the tube length.

2. The muffler of claim 1 wherein an inlet section of the venturi tube admits gases into the tube and forms said inlet into the housing.

3. The muffler of claim 1 wherein an outlet section of the venturi tube exhausts gases passing through the tube and forms said outlet from the housing.

4. A muffler defining a portion of a path for exhaust gases from an internal combustion engine comprising a housing and a venturi at least partially within the housing defining a path for exhaust gases passing through the housing, the venturi having a centerline, an inlet section at one end to admit exhaust gases, an outlet section at an opposing end to release exhaust gases, a throat section intermediate the inlet section and the outlet section having a transverse cross-sectional area normal to the centerline less than the transverse cross-sectional area normal to the centerline in either the inlet section or the outlet section, a reduction chamber section connecting said inlet section and said throat section and diminishing in transverse cross-sectional area normal to the centerline between the inlet section and the throat section, and an expansion chamber section connecting said throat section and said outlet section and increasing in transverse cross-sectional area normal to the centerline between the throat section and the outlet section, the improvement wherein the venturi is formed from a single length of tubing having a uniform transverse circumferential wall length in planes normal to the centerline at each point along the centerline.

5. In the muffler of claim 4 said venturi having dimensions selected to maximize noise attenuation while minimizing exhaust gas back pressure to the internal combustion engine.

6. In the muffler of claim 4, said venturi wherein the inlet and outlet each has the same transverse cross-sectional area and the throat section has a transverse cross-sectional area about 40% of said same transverse cross-sectional area.

7. In the muffler of claim 4, said venturi wherein the throat section is elongated, of substantially uniform transverse cross-sectional area along its length, and at least as long as the reduction chamber section.

8. In the muffler of claim 4, said venturi wherein the expansion chamber section is at least twice as long as the reduction chamber section.

9. In the muffler of claim 8, said venturi wherein the expansion chamber section is at least twice as long as the combined length of the reduction chamber section and throat section.

10. In the muffler of claim 9, said venturi wherein the throat section is elongated and of substantially uniform transverse cross-sectional area along its length and at least as long as the reduction chamber section.

11. In the muffler of claim 10, said venturi wherein the inlet and outlet sections have the same transverse cross-sectional area and the throat section has a transverse cross-sectional area about 40% of said same transverse 12. In the muffler of claim 7, said venturi wherein the inlet and outlet sections have the same transverse cross-sectional area and the throat section has a transverse cross-sectional about 40% of said same transverse cross-sectional area.

13. A muffler defining a portion of a path for exhaust gases from an internal combustion engine comprising:
   a housing; and
   a venturi at least partially within the housing and forming a portion of said gas path through said housing and comprising:
      a tubular sidewall defining a pair of opposing, substantially circular open ends and surrounding a centerline extending between the open ends, the venturi having at each point along the centerline and at the open ends, a transverse cross-sectional area normal to the centerline and a major axis extending between a pair of most divergent points of the sidewall in the plane of the transverse cross-sectional area;
      a first section of the sidewall near one of said open ends having transverse cross-sectional areas diminishing in magnitude and major axes increasing in magnitude as the first section extends from near said one open end towards the remaining open end;
      a second section of the sidewall near the remaining open end having transverse cross-sectional areas diminishing in magnitude and major axes increasing in magnitude as the second extends from near the remaining open end towards the one open end; and said first and second sections of the sidewall each having at least one major axis greater than the major axes at either of said open ends.

14. The muffler of claim 13 wherein said venturi comprises a single length of bent tubing having said tubular sidewall, said sidewall being of uniform, transverse circumference in the plane of the transverse cross-sectional area at each point of the centerline along said length.

15. A muffler defining a portion of a path for exhaust gases from an internal combustion engine comprising:

a housing; and a hollow tube forming a portion of the exhaust gas path through the housing and having a sidewall, a pair of opposing substantially circular open ends, a central axis between the open ends, and a transverse cross-sectional area at each point along the central axis normal to the central axes;

a throat section of the tube between the open ends having the minimal transverse cross-sectional area of the tube;

a first section of the tube between one open end and the throat section having two opposing sections of the sidewall diverging from the central axis as the tube extends from the one open end to the throat section; and a second section of the tube between the remaining open end and throat section having two opposing sections of the sidewall diverging from the central axis as the tube extends from the remaining open end to the throat section.

16. The muffler of claim 15, wherein said hollow tube has a substantially uniform transverse sidewall circumference at each point along the central axis.

* * * * *